US009144339B2

(12) United States Patent
Cannata

(10) Patent No.: US 9,144,339 B2
(45) Date of Patent: Sep. 29, 2015

(54) DEVICE TO DRESS SOCKS ON AND OFF

(76) Inventor: Joseph M. Cannata, Highland Heights, OH (US)

( * ) Notice: Subject to any disclaimer, the term of this patent is extended or adjusted under 35 U.S.C. 154(b) by 0 days.

(21) Appl. No.: 13/483,012

(22) Filed: May 29, 2012

(65) Prior Publication Data

US 2012/0298701 A1 Nov. 29, 2012

Related U.S. Application Data

(60) Provisional application No. 61/519,716, filed on May 28, 2011.

(51) Int. Cl.
*A47G 25/90* (2006.01)

(52) U.S. Cl.
CPC ..... *A47G 25/905* (2013.01)

(58) Field of Classification Search
CPC . A47G 25/905; A47G 25/907; A47G 25/908; A47G 25/80; A47G 25/82; A47G 25/86
USPC ..... 223/111–114, 118
See application file for complete search history.

(56) References Cited

U.S. PATENT DOCUMENTS

| | | | | | |
|---|---|---|---|---|---|
| 2,939,618 | A * | 6/1960 | Mangels | 223/113 |
| 3,310,209 | A * | 3/1967 | Clauss | 223/111 |
| 4,943,097 | A * | 7/1990 | Sanger | 223/111 |
| D310,908 | S * | 10/1990 | Santore | D2/642 |
| 5,826,761 | A * | 10/1998 | Basaj | 223/112 |
| 5,927,573 | A * | 7/1999 | Votino et al. | 223/111 |
| 6,056,171 | A * | 5/2000 | Santamaria | 223/112 |
| 6,698,630 | B1 * | 3/2004 | Maguire | 223/118 |
| 6,932,252 | B2 * | 8/2005 | Simmons | 223/111 |
| 6,942,129 | B2 * | 9/2005 | Ferraioli | 223/113 |
| 7,234,616 | B2 * | 6/2007 | Thom et al. | 223/112 |
| 7,287,675 | B1 * | 10/2007 | Sullivan et al. | 223/111 |
| 2011/0049201 | A1 * | 3/2011 | Bertinotti | 223/112 |

OTHER PUBLICATIONS

Website, Elderstore.com, Rigid Formed Sock Aid with Foam Grips www.elderstore.com/rigid-formed-sock-aid-with-foam-grips.aspx Jun. 13, 2012, 1 page.
Website, Sockgatereacher.com, SockGate Reacher www.sockgatereacher.com Apr. 28, 2011, 1 page.
Website, Sockgenie.com, The NEW Simmons Sock Genie www.sockgenie.com May 5, 2012, 2 pages.
Patterson Medical Sammons Preston Enrichments Catalog Bolingbrook, IL 2010, Cover and pp. 22-23.
Joseph M. Cannata Annotated p. 22-23 of Sammons Preston Enrichments Catalog Bolingbrook, IL 2010, 1 page.
Joseph M. Cannata Website: Get Socks on http://getsockson.com/ Jun. 4, 2011, index and shop online, 2 pages.

* cited by examiner

*Primary Examiner* — Nathan Durham
(74) *Attorney, Agent, or Firm* — D.A. Stauffer Patent Service, LLC

(57) ABSTRACT

The invention discloses a device for putting a sock or a shoe on or off. The device includes a long rigid arm with a distal end and a proximal end. The device includes a sleeve with its proximal end coupled to the distal end of the arm and a distal end of the sleeve including one or more tongues spaced apart by valleys that define sides of each tongue. At the proximal end of the arm is a right angle handle being broadly curved in a partly hooked shape, followed by a reverse bend to provide a short reverse end hook.

12 Claims, 9 Drawing Sheets

DEVICE TO DRESS SOCKS ON AND OFF

CROSS-REFERENCE TO RELATED APPLICATIONS

This application claims benefit from the following provisional application, which has a common applicant, and all of which is incorporated in its entirety herein by reference:

US Provisional patent application entitled GET SOCK ON, Application Ser. No. 61/519,716 filed May 28, 2011 by Joseph M. Cannata.

TECHNICAL FIELD

The present invention relates to a device for clothes dressing accessories, and in particular to a device for putting on socks and for removing them off from the body.

BACKGROUND

It has been recognized that clothes dressing activities, particularly actions of putting on or taking off socks and shoes which require articulation of back, spine, or other joints may be difficult for some persons. For example, people who are obese or who suffer from spine, back, hip, knee or any other lower body disorder/problem find it difficult to articulate their problem joint(s). This affects their ability to dress themselves with shoes or socks or any other accessory that requires articulation of a body part such as back or knee.

Various types of devices and apparatuses have become available to facilitate dressing of such as socks. However, those devices lack the comfort and easy to use component. Some of them facilitate dressing of socks but do not provide a way for removal of the socks from the body because of which a person may have difficulty during removal or pulling the socks off.

In light of the above, there is a need for a device that is simple and easy to use for pulling on as well pulling off the socks. In addition, the device may facilitate in several other usual tasks.

SUMMARY

The invention discloses a device for pulling a sock on or off. The device includes a long rigid arm with a distal end and a proximal end. A length of the arm is defined between the proximal end and the distal end. The device includes a sleeve with its proximal end coupled to the distal end of the arm and a distal end of the sleeve including at least two tongues distant apart by a space therebetween.

In an embodiment, the long rigid arm includes a hook positioned at the proximal end of the long rigid arm. In an embodiment, the sleeve includes a flange located proximally and bent against the sleeve. In an embodiment, the arm is configured as a dressing stick. In an embodiment, the sleeve includes an inner wall defining an inner surface of the sleeve. The inner surface of the sleeve defines a curvature from its proximal end to the distal end and extending along a length of the sleeve longitudinally. In an embodiment, the curvature of the inner surface of the sleeve is in conformation to human anatomy or shape of the foot. In an embodiment, the arm is coupled to the sleeve with the use of permanently coupling technique. In an embodiment, the at least two tongues include a first tongue, a second tongue and a third tongue.

Figure 1:
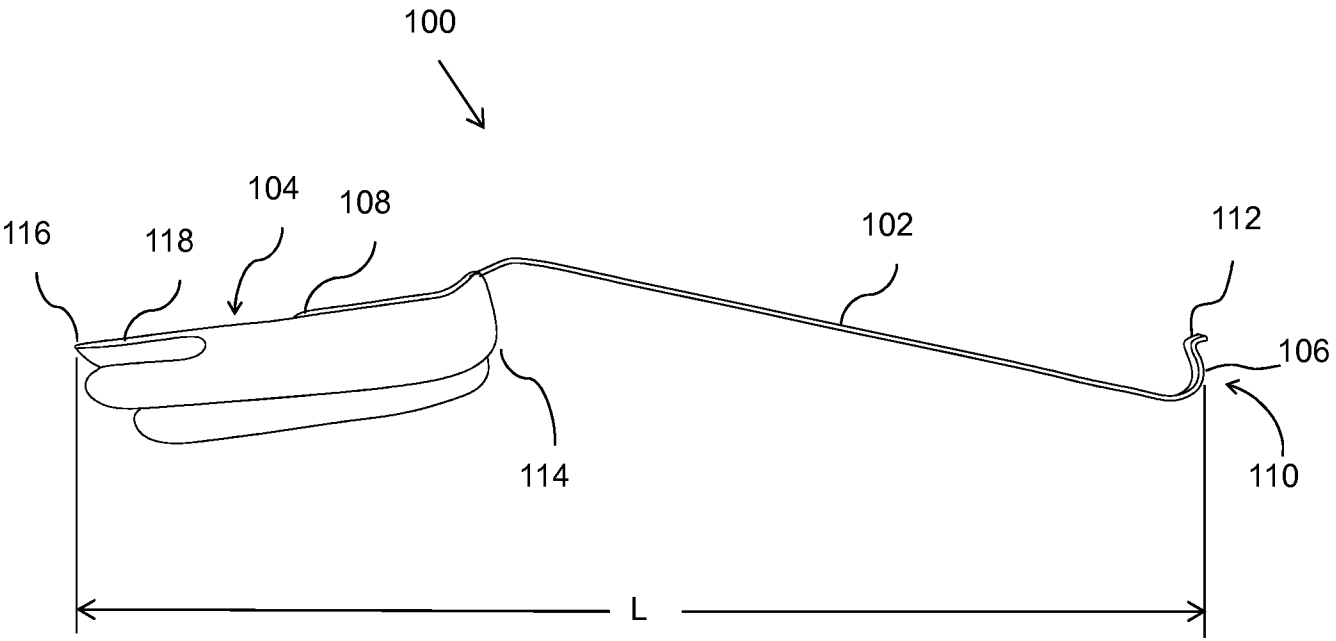
FIG. 1 shows a perspective view of an exemplary device, in accordance with an embodiment of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The terms "a" or "an," as used herein, are defined as one or more than one. The term "another," as used herein, is defined as at least a second or more. The terms "including" and/or "having", as used herein, are defined as comprising (i.e., open transition).

The terms proximal and distal described in relation to various devices, apparatuses, and components, as discussed in the subsequent text of the present invention, are referred with a point of reference. The point of reference, as used in this description, is a perspective of a user.

FIG. 1 shows a perspective view of an exemplary device 100, in accordance with an embodiment of the present invention. The device 100 can include a long rigid arm 102 (hereafter referred to as arm 102 for the simplicity of the description), and a sleeve 104.

The arm 102 includes a proximal end 106 and a distal end 108. The proximal end 106 of the arm 102 can be coupled to a handle 110. The handle 110 can include a reverse hook 112 or any other curved design or shape. The handle 110 can be an integral, formed part of the arm 102 or can be removably attached thereto for holding purposes.

The sleeve 104 can be coupled to the distal end 108 of the arm 102 with the use of fasteners. In an embodiment, the sleeve 104 can be coupled to the arm 102 permanently with the use of permanent fasteners. In another embodiment, the sleeve 104 can be coupled to the arm 102 removably with the use of removable fasteners. The sleeve 104 can include a proximal end 114 and a distal end 116. The sleeve 104 includes at least one tongue 118 located at the distal end 116 of the sleeve 104. In an embodiment, the sleeve 104 can include three tongues 118, as shown in FIG. 1. However, it must be appreciated that one, two, or more than three tongues similar to the three tongues 118 may also be possible within the purview of the current invention.

Figure 2:
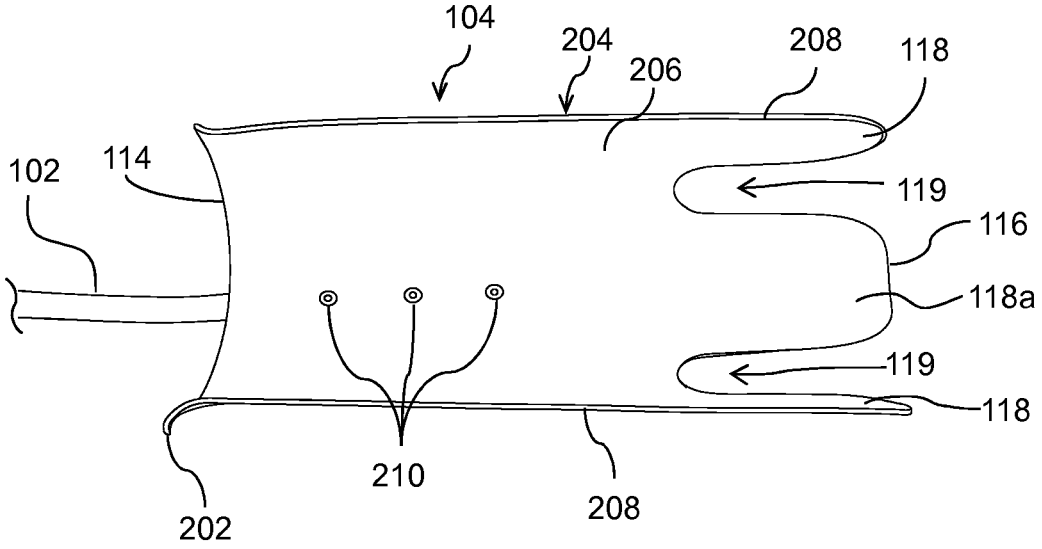
FIG. 2 shows an enlarged view of a portion of the device of FIG. 1, in accordance with an embodiment of the present invention.

FIG. 2 shows an enlarged view of a portion of the device 100 of FIG. 1, in accordance with an embodiment of the present invention. The enlarged view shows the sleeve 104 with three tongues 118. Referring now to FIGS. 1 and 2, the sleeve 104 is described. As shown, the sleeve 104 includes three tongues 118, in accordance with an exemplary embodiment. The sleeve 104 can include a flanged portion (or simply a flange) 202 located proximally on the sleeve 104. The sleeve 104 includes two lateral edges 208 extending longitudinally along the sleeve length. The sleeve 104 also includes a wall 204 defining an inner surface 206 of the sleeve 104 that directly comes in contact with socks or skin. In an embodiment, the inner surface 206 of the sleeve 104 defines a lateral curvature between the two lateral edges 208 along a length of the sleeve 104 longitudinally, such that the wall 204 is curved around the inner surface 206 of the sleeve 104. In an embodiment, the entire curvature of the inner surface 206 of the sleeve 104 is in conformation to the human anatomy or shape of the lower leg and foot that is inserted within a space created by the curved inner surface 206 of the sleeve 104. The curvature is such that a space is left between the two lateral edges 208, for example a front side is left open to a width approximately equal to the side-to-side dimension of the space created by the curved inner surface 206. In other words, the inner surface 206 is approximately U-shaped.

In an embodiment, the three tongues 118 are separated by valleys 119 that can be uniform in width or vary for each of the tongues 118. A middle tongue 118*a*, which is the only tongue 118 in an embodiment with one tongue 118, is aligned with the distal end 108 of the arm 102 such that it can be used as a long-armed shoehorn for putting shoes on, or for pushing them off, as illustrated in FIG. 4G. In this embodiment, then, the valleys 119 allow the middle tongue 118*a* to be inserted into the heel of a shoe while the other tongues 118 remain outside the shoe. The tongues 118 are further configured to provide inward bending flexibility at the sleeve's distal end 116 so as to ease application of a sock on the sleeve 104 which is larger in diameter than the sock when it is worn on the foot. For example, a first tongue and a second tongue of the three tongues 118 may be configured to exert expansion force at the sides of the sock, while a third tongue 118*a* may exert expansion force at the back (heel) side of the socks.

In an embodiment, the flange 202 can be configured to be bent away from the inner surface 206 so as to avoid any harm or damage to the leg because of a possibly sharp edge of the flange. A user's leg can be easily inserted into the space of the sleeve 104 without directly contacting the edge of the flange 202.

The sleeve 104, as shown, includes three locations 210 for fastening the sleeve 104 to the arm 102 at three distinct locations. In an embodiment, the sleeve 104 can be configured to be coupled to the arm 102 at one or two or more than three distinct locations. In an embodiment, the sleeve 104 can be configured to be coupled to the arm 102 permanently with the use of techniques such as soldering, welding, or any other similar technique.

Figure 3:
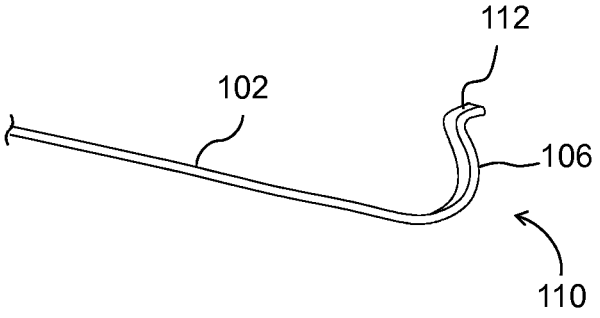
FIG. 3 shows an enlarged view of a portion of the device of FIG. 1, in accordance with an embodiment of the present invention.

FIG. 3 shows an enlarged view of a portion of the device 100 of FIG. 1, in accordance with an embodiment of the present invention. Referring now to FIGS. 1 and 3, the proximal end 106 of the arm 102 of the device 100 is described.

As described above, the arm 102 is coupled to the sleeve 104 distally and includes the handle 110 at its proximal end 106. The handle 110 can be configured to serve several purposes. In an embodiment, the handle 110 may be broadly curved in a partly hooked shape as shown, with a convex shape at the proximal end 106 of the arm 102. The handle 110 may be curved to be generally right angled with respect to the arm 102. The handle 110 can be configured to be used for hanging the device 100 on such as a wall peg, a chair back, a table edge, a doorknob, and the like. The right angle configuration of the handle 110 is comfortable to hold, and facilitates holding and controlling use of the device 100 with only one hand, including either pushing or pulling the device 100. The rigidity of the arm 102 facilitates pushing as in removing shoes and socks (FIGS. 4F and 4G). The long, rigid arm 102 also facilitates leaning of the device 100 against a wall or such, potentially aided by rigidity of the sleeve 104 and tongue(s) 118, or by the shape of the handle 110. The handle 110 at the end of the long rigid arm 102 can be used to reach and pick up shoes or socks from the floor without needing to bend down. A convenient overall length L for this device 100, which has a "long arm" relative to other similarly purposed prior art devices, is approximately 30 inches from the proximal end 106 of the arm 102 (and handle 110) to the distal end 116 of the sleeve 104 (and tongue(s) 118). However it is within the scope of the present invention to vary the overall length L within a range of about 22 inches to about 35 inches.

In an embodiment, the handle 110 may be reverse bent at its end to provide a short reverse hook 112 (end hook 112) that provides additional beneficial functionality to the device 100. In particular, combining the long rigid arm 102 with the resultant double bend shape of the handle 110 with short end hook 112 turns the device 110 into a form of dressing stick that can be used to push or pull clothing as desired. More particularly, as shown in FIG. 4F the reverse end hook 112 of this embodiment is especially suited for pushing off socks or shoes (instead of using the tongue 118 and valleys 119 to push as described hereinabove with reference to FIG. 4G). The short end hook 112 may be configured to match the depth of the handle 110 curvature such that the device will stand upside down with the sleeve 104 at lap height to facilitate pushing or pulling a sock down over the sleeve 104. The reversed end hook 112 will help keep the handle 110 from slipping on the floor, and also makes the arm 102 stand straight when a foot is used to hold down the handle 102 against the floor.

Figure 4A:
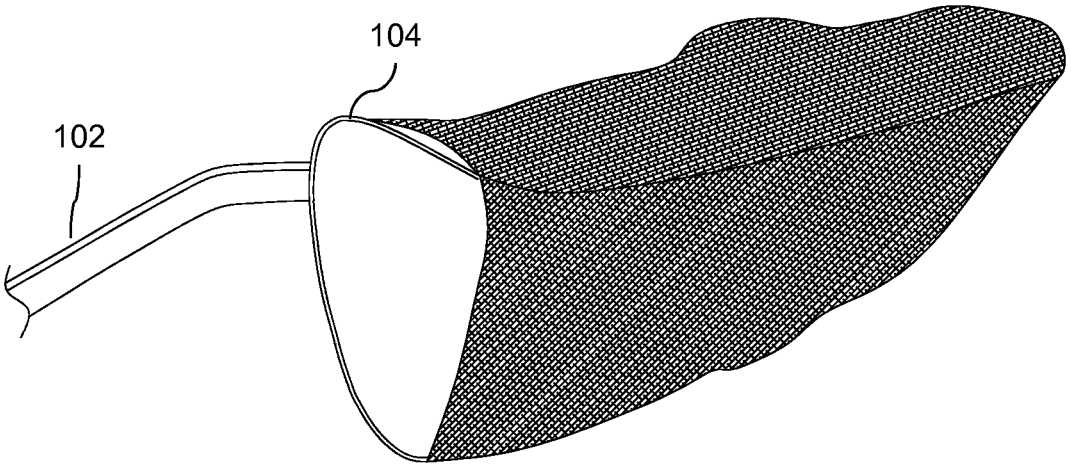
FIGS. 4A-4E show a procedure or method of dressing a sock with use of the device of FIG. 1, in accordance with an embodiment of the present invention.
Figure 4B:
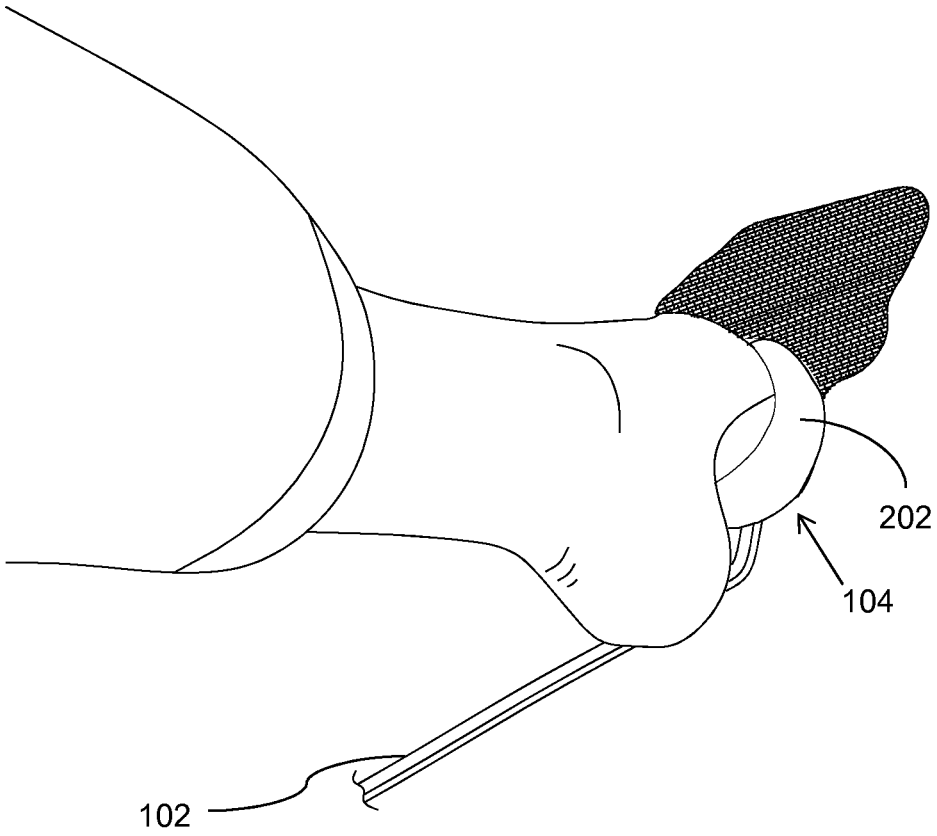
Figure 4C:
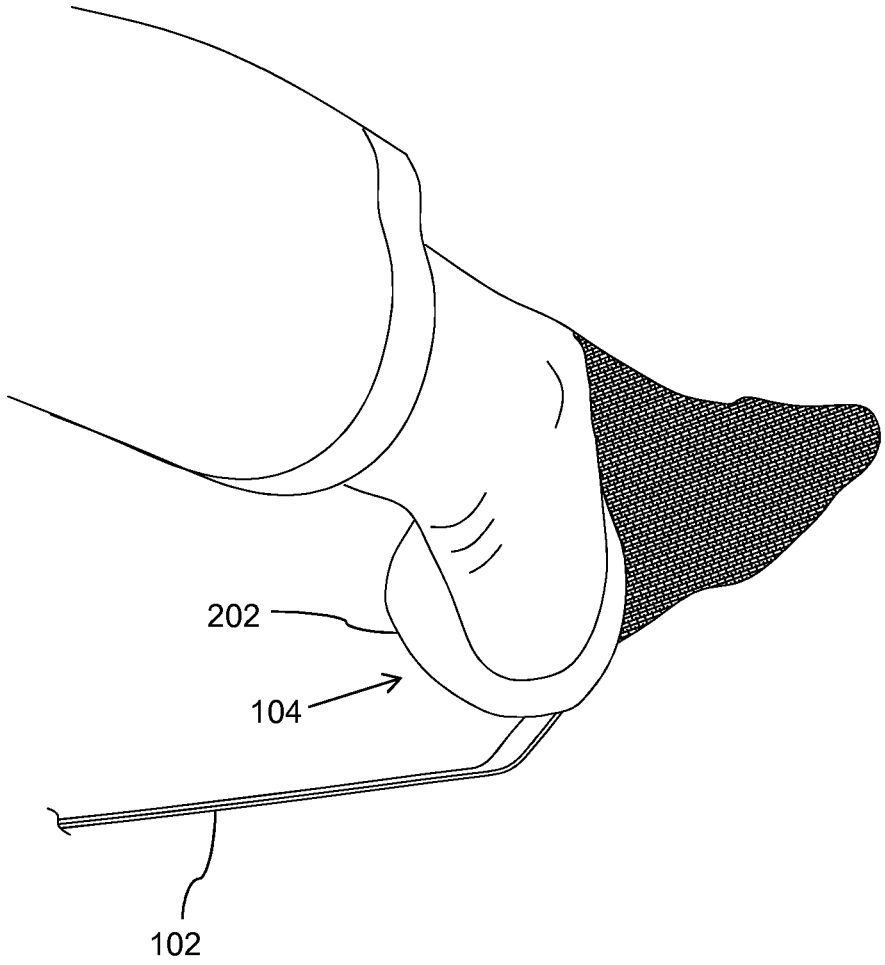

FIGS. 4A-4E show a procedure or method of dressing with a sock or a shoe by use of the device 100 of FIG. 1, in accordance with an embodiment of the present invention. As shown in FIG. 4A, after a user picks up a sock with the use of any of the tongues 118 or the hooked handle 110; then the user can wrap the sock over the sleeve 104 of the device 100 such that the heel is proximate the middle tongue 118*a* (back side of the sleeve 104). In this state, the entire or a substantial part of the sleeve 104 is enclosed within the sock. The lateral curvature defined by the sleeve wall 204 causes a space created therein within the sock so as to enter a portion of the leg such as foot inside the created space. The user can hold the arm 102 upright in his hand and cause the foot to enter the hollow space created inside the sock, as shown in FIGS. 4B and 4C.

Figure 4D:
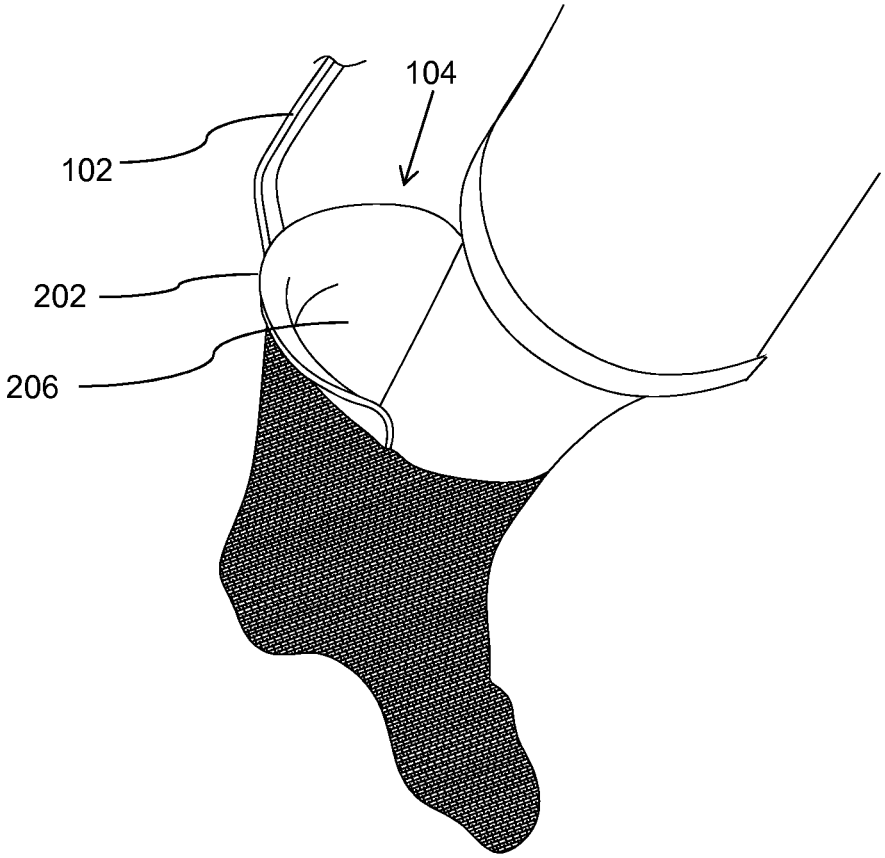
Figure 4E:
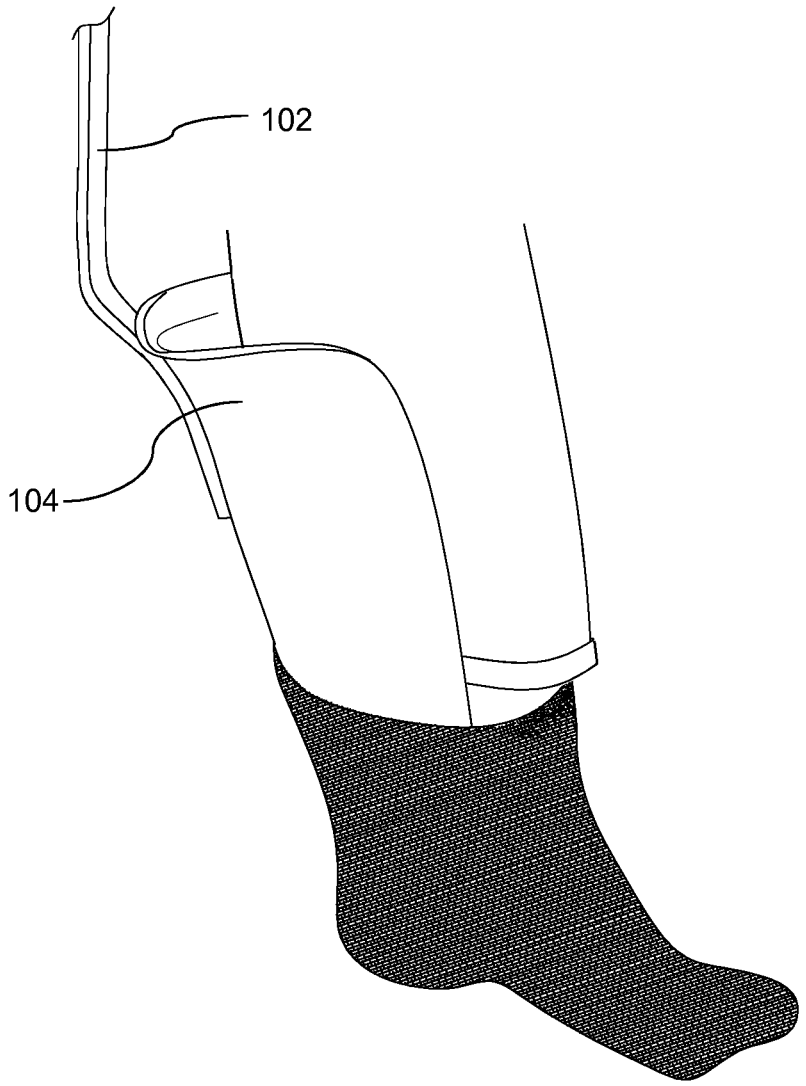
Figure 4F:
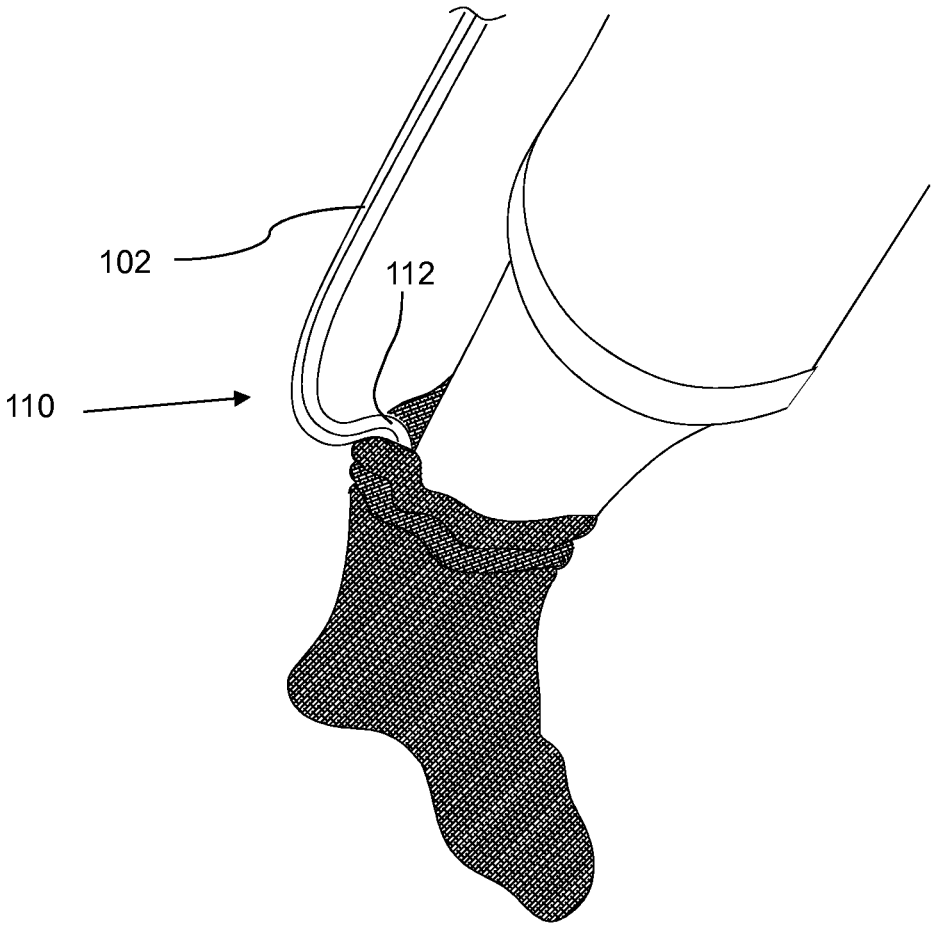
FIG. 4F shows a procedure or method of removing a sock with use of the device of FIG. 1, in accordance with an embodiment of the present invention.
Figure 4G:
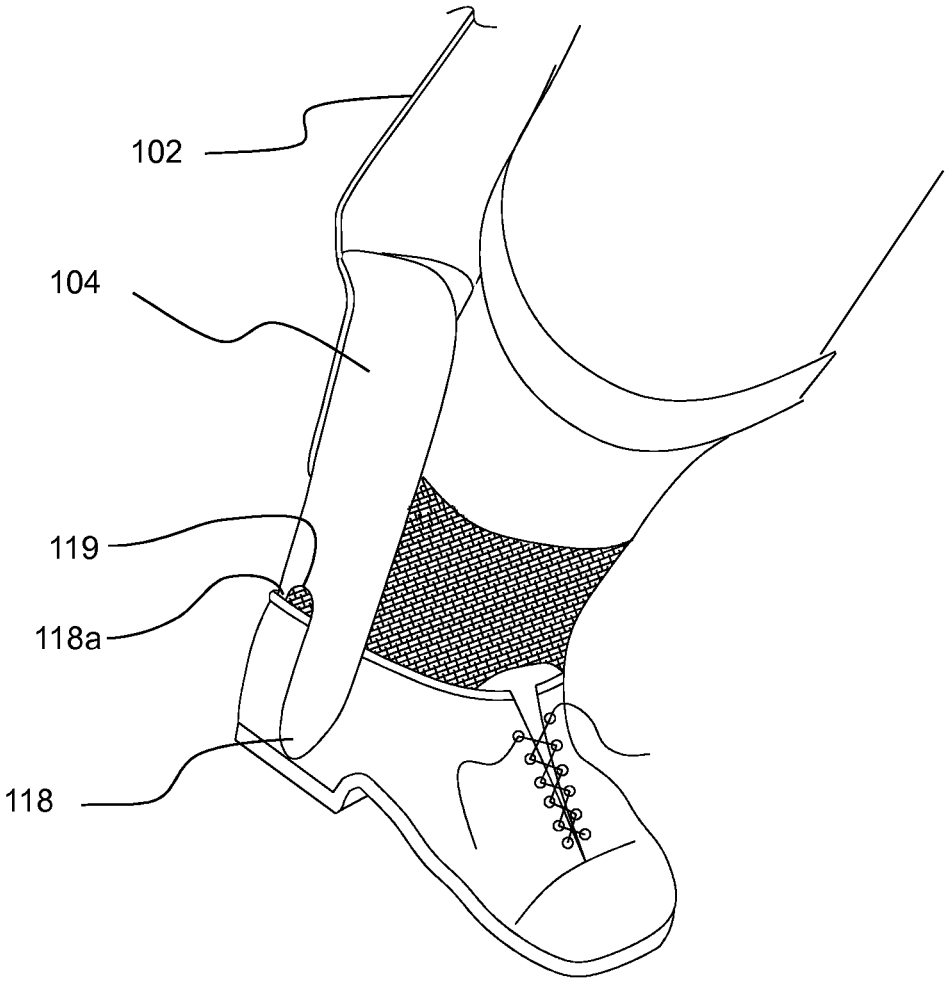
FIG. 4G shows a procedure or method of putting on or taking off a shoe with use of the device of FIG. 1, in accordance with an embodiment of the present invention.

The sleeve curvature allows the foot to enter the socks smoothly. Once the entire foot rests inside the socks as shown in FIG. 4D, the user can pull the arm 102 away from the socks gradually, as shown in FIG. 4E. This allows removal of the sleeve 104 or the device 100 from the leg or sock and thereby leaves the foot inside the sock in condition for wearing the sock. Similarly, the device 100 can be used to dress a sock for the other leg also. After that, in a similar method, a shoe can be reached and picked up by the handle 110 on the arm 102; placed upright on the floor in front of the user; applied to the sleeve 104 by inserting the middle tongue 118*a* into the heel of the shoe (leaving other tongues 118 outside of the shoe); and inserting the foot into the shoe as done with a shoehorn—pushing the foot downward and forward, assisted by forward pressure from the tongue 118*a* (and shoe heel) as the heel slides down against the tongue 118*a*.

In accordance with the illustrated embodiments, the device 100 is used for pulling the socks on or pushing them off. However, in some embodiments, the device 100 can be used in the same way for shoes.

The illustrated FIGS. 4A-4E show an exemplary way of pulling on the socks. However, the device 100 can be used for pushing off the socks as well. Referring to FIG. 4F, for example, the hook 112 of the device 100 can facilitate removal of the socks. The user can insert the hook 112 within the sock covering and then exert a pressure downward toward the foot so as to cause the sock to be pushed off. In some embodiments, any of the three tongues 118 of the sleeve 104 such as the middle tongue 118*a* can be used to exert the required force for pushing off the socks. In particular, the valleys 119 between tongues 118 will push on the sock when a tongue (e.g., 118*a*) is pushed into the sock on a foot, or the tongue 118 may catch on the sock and supply the pushing force by itself. Referring to FIG. 4G, the middle tongue 118*a* (or any other tongue 118) can also be used to push the shoes off, or the middle tongue 118*a* can be used more conventionally as a long handled shoehorn for putting on shoes.

In accordance with embodiments, the device 100 provides several advantages. Some of them are presented below.

In an embodiment, the device 100 facilitates putting on or taking off shoes or socks without significant bending or articulating of the user's back, hips or knee. This especially helps people who underwent any surgical treatment (e.g., hip replacement surgery), who have deteriorated or injured legs or joints, or who are obese.

In an embodiment, the handle 110 and long rigid arm 102 of the device 100 facilitate holding and controlled use of the device 100 by one hand.

In an embodiment, the handle 110 at the end 106 of the long rigid arm 102 facilitates picking up socks or shoes from the floor.

In an embodiment, the reverse hook 112 or the tongues 118 facilitate removal of socks and shoes from the body.

In an embodiment, the handle 110 facilitates hanging of the device 100.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

I claim:

1. A device for pulling a sock on a foot, the device comprising:

a long rigid arm with a distal end and a proximal end;

a sleeve with a proximal end coupled to the distal end of the arm and a distal end of the sleeve including one or more tongues spaced apart by valleys that define sides of each tongue; and a handle extending generally at a right angle from the proximal end of the long rigid arm, the handle being configured to cause the device to stand upside down substantially vertically when the handle is pressed down against a floor, the handle being broadly curved in a lateral direction comprising a convex outward curve extending from the proximal end of the arm to reach an apex and continuing back inward, then changing to a shorter concave outward reverse bend to provide the handle with a short reverse end hook, wherein the free end of the reverse bend and the apex of the convex curve are aligned in a plane that is substantially orthogonal to the long rigid arm.

2. The device of claim 1, wherein the arm and handle are configured as a dressing stick.

3. The device of claim 1, wherein the long rigid arm is configured to give the device an overall length within a range of about 22 inches to about 35 inches measured from the proximal end of the arm to the distal end of the sleeve.

4. The device of claim 3, wherein the long rigid arm is configured to give the device an overall length of approximately 30 inches.

5. The device of claim 1, wherein the sleeve includes a wall defining an inner surface of the sleeve, the inner surface of the sleeve defining a lateral curvature between two lateral edges along a length of the sleeve longitudinally, such that the wall is curved around the inner surface of the sleeve.

6. The device of claim 5, wherein the curvature of the inner surface of the sleeve is in conformation to human anatomy or shape of the foot and lower leg.

7. The device of claim 5, wherein the inner surface of the sleeve is approximately U-shaped to leave an open front side of the sleeve.

8. The device of claim 1, wherein the arm is configured to be removably coupled to the sleeve with the use of a fastener.

9. The device of claim 1, wherein the arm is coupled to the sleeve with the use of a permanent coupling technique.

10. The device of claim 1, wherein the one or more tongues comprise:

a first tongue, a second tongue and a third tongue, wherein the second tongue is a middle tongue positioned at a back, heel portion of the sleeve, aligned with the distal end of the arm; and a valley on each side thereof separates the middle tongue from the first and third tongues, which are positioned at opposed side, ankle portions of the sleeve.

11. The device of claim 1, wherein the sleeve includes a flange located proximally and bent outward, away from an inside surface of the sleeve.

12. The device of claim 1, wherein the reverse end hook has a curve with a depth substantially the same as the depth of the convex curve of the handle, the curves of the handle thus being configured to allow a foot to be used to hold down the handle against the floor.

* * * * *